US011626651B2

(12) United States Patent
Ogawa et al.

(10) Patent No.: US 11,626,651 B2
(45) Date of Patent: Apr. 11, 2023

(54) FILTER

(71) Applicant: Soshin Electric Co., Ltd., Saku (JP)

(72) Inventors: Keisuke Ogawa, Otsu (JP); Hitoshi Makino, Miyazaki (JP)

(73) Assignee: Soshin Electric Co., Ltd, Saku (JP)

( * ) Notice: Subject to any disclaimer, the term of this patent is extended or adjusted under 35 U.S.C. 154(b) by 160 days.

(21) Appl. No.: 17/309,279

(22) PCT Filed: Nov. 1, 2019

(86) PCT No.: PCT/JP2019/042979
§ 371 (c)(1),
(2) Date: May 14, 2021

(87) PCT Pub. No.: WO2020/105396
PCT Pub. Date: May 28, 2020

(65) Prior Publication Data

US 2022/0006170 A1 Jan. 6, 2022

(30) Foreign Application Priority Data

Nov. 19, 2018 (JP) ..... JP2018-216259

(51) Int. Cl.
*H01P 1/20* (2006.01)
*H01P 1/203* (2006.01)
*H01P 7/08* (2006.01)

(52) U.S. Cl.
CPC ..... *H01P 1/20345* (2013.01); *H01P 1/20* (2013.01); *H01P 7/082* (2013.01)

(58) Field of Classification Search
CPC .. H01P 1/20345; H01P 1/20336; H01P 1/203; H01P 1/20327; H01P 1/202;
(Continued)

(56) References Cited

U.S. PATENT DOCUMENTS

2002/0030561 A1 3/2002 Masuda et al.
2010/0214037 A1* 8/2010 Plager ..... H03H 7/1791 333/185
2015/0236427 A1 8/2015 Asai

FOREIGN PATENT DOCUMENTS

JP H06-041202 U 5/1994
JP 2002-094349 A1 3/2002
(Continued)

OTHER PUBLICATIONS

International Search Report and Written Opinion (Application No. PCT/JP2019/042979) dated Jan. 21, 2020.
(Continued)

*Primary Examiner* — Stephen E. Jones
(74) *Attorney, Agent, or Firm* — Burr Patent Law, PLLC

(57) ABSTRACT

Provided is a filter capable of suppressing variation in characteristics. A filter has: a plurality of resonators each having a via electrode and a first strip line that is opposed to a first shielding conductor and connected to one end of the via electrode; a first coupling capacitive electrode that has a first comb-shaped electrode including a plurality of first electrodes and that is provided to the first resonator; and a second coupling capacitive electrode that is provided to the second resonator, that has a second comb-shaped electrode including a plurality of second electrodes, and that is formed on the same layer as that of the first coupling capacitive electrode, wherein the first and second electrodes are arranged so as to be adjacent to each other.

9 Claims, 13 Drawing Sheets

(58) Field of Classification Search
CPC .. H01P 1/20; H01P 1/201; H01P 7/082; H01P 7/04; H01P 7/08; H01P 7/10; H03H 7/01; H03H 7/0115; H03H 7/0123
See application file for complete search history.

(56) References Cited

FOREIGN PATENT DOCUMENTS

| | | | |
|---|---|---|---|
| JP | 2014-068166 | A1 | 4/2014 |
| JP | 2017-195565 | A1 | 10/2017 |

OTHER PUBLICATIONS

Chinese Office Action (Application No. 201980075981.7) dated Sep. 7, 2021 (with English translation).

* cited by examiner

FILTER

TECHNICAL FIELD

The present invention relates to a filter.

BACKGROUND ART

There has been proposed a filter which has a plurality of resonators formed inside a laminated body substrate configured by stacking dielectric sheets (Japanese Laid-Open Patent Publication No. 2017-195565). In the filter described in Japanese Laid-Open Patent Publication No. 2017-195565, one resonator and another resonator are coupled by a capacitor formed using a coupling adjustment line.

SUMMARY OF INVENTION

However, in the filter proposed in Japanese Laid-Open Patent Publication No. 2017-195565, if thickness of the dielectric sheets varies, then capacitance of the capacitor will vary, which will consequently lead to a variation in filter characteristics.

An object of the present invention is to provide a filter which is capable of suppressing variation in characteristics.

A filter according to an aspect of the present invention includes: a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; a first coupling capacitance electrode which is provided to a first resonator among the plurality of resonators and includes a first comb-shaped electrode including a plurality of first electrodes; and a second coupling capacitance electrode which is provided to a second resonator adjacent to the first resonator, includes a second comb-shaped electrode including a plurality of second electrodes, and is formed in the same layer as the first coupling capacitance electrode, wherein the first electrodes and the second electrodes are disposed so as to be alternately adjacent to each other.

The present invention makes it possible to provide a filter enabling variation in characteristics to be suppressed.

DESCRIPTION OF EMBODIMENTS

Preferred embodiments of a filter according to the present invention will be presented and described in detail below with reference to the accompanying drawings.

First Embodiment

Figure 1:
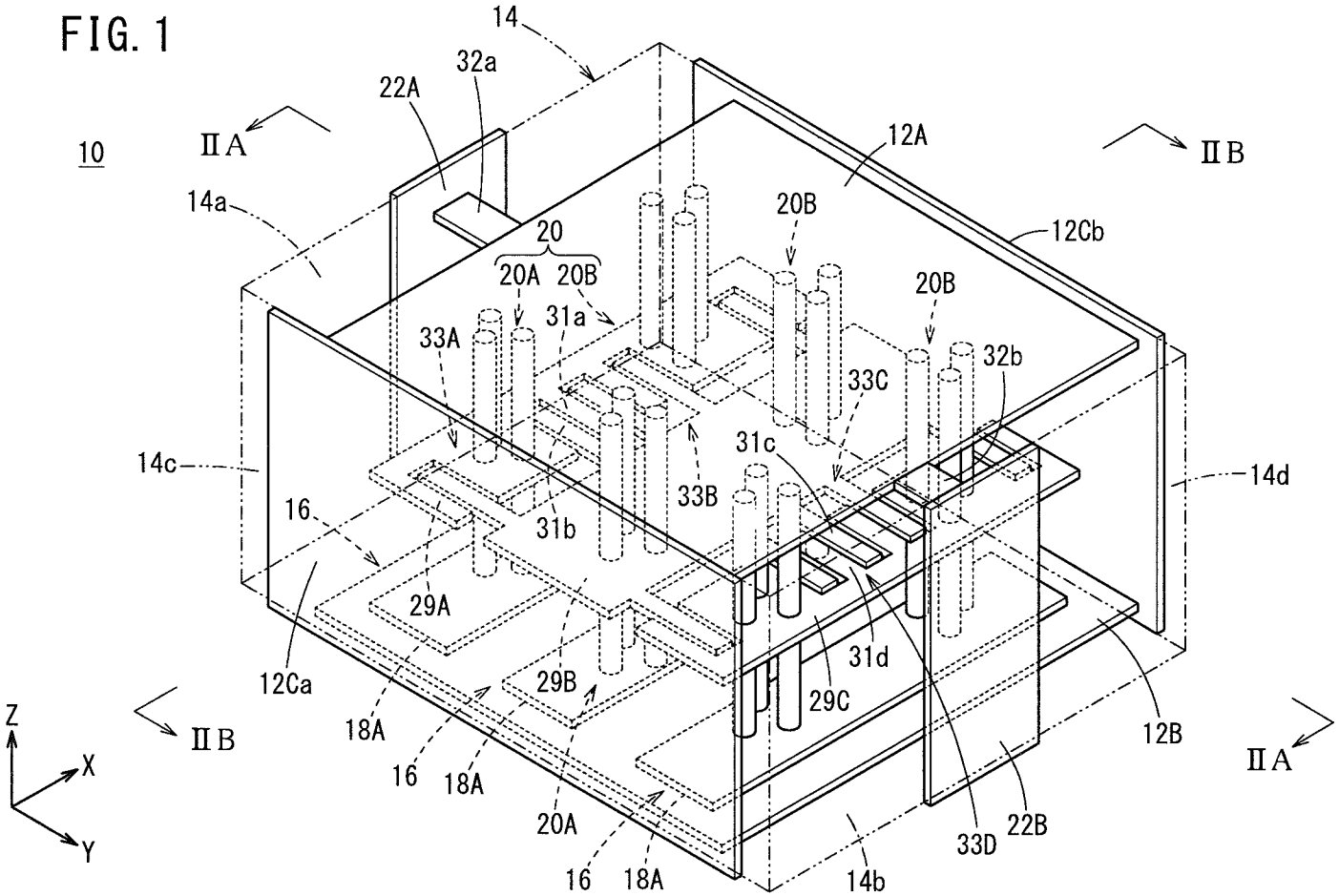
FIG. 1 is a perspective view showing a filter according to a first embodiment.
Figure 2A:
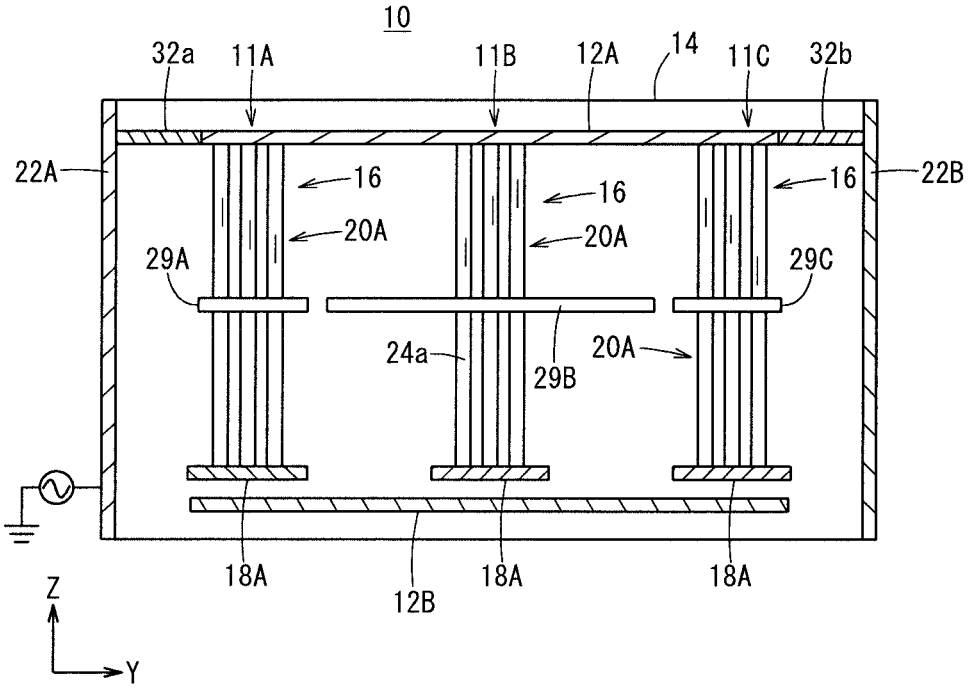
FIGS. 2A and 2B are cross-sectional views showing the filter according to the first embodiment.
Figure 2B:
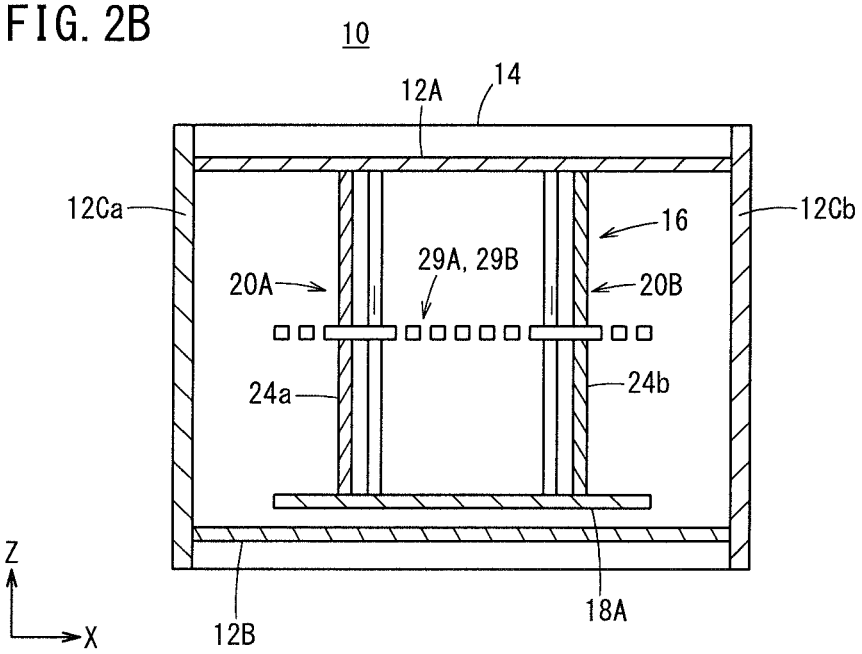
Figure 3:
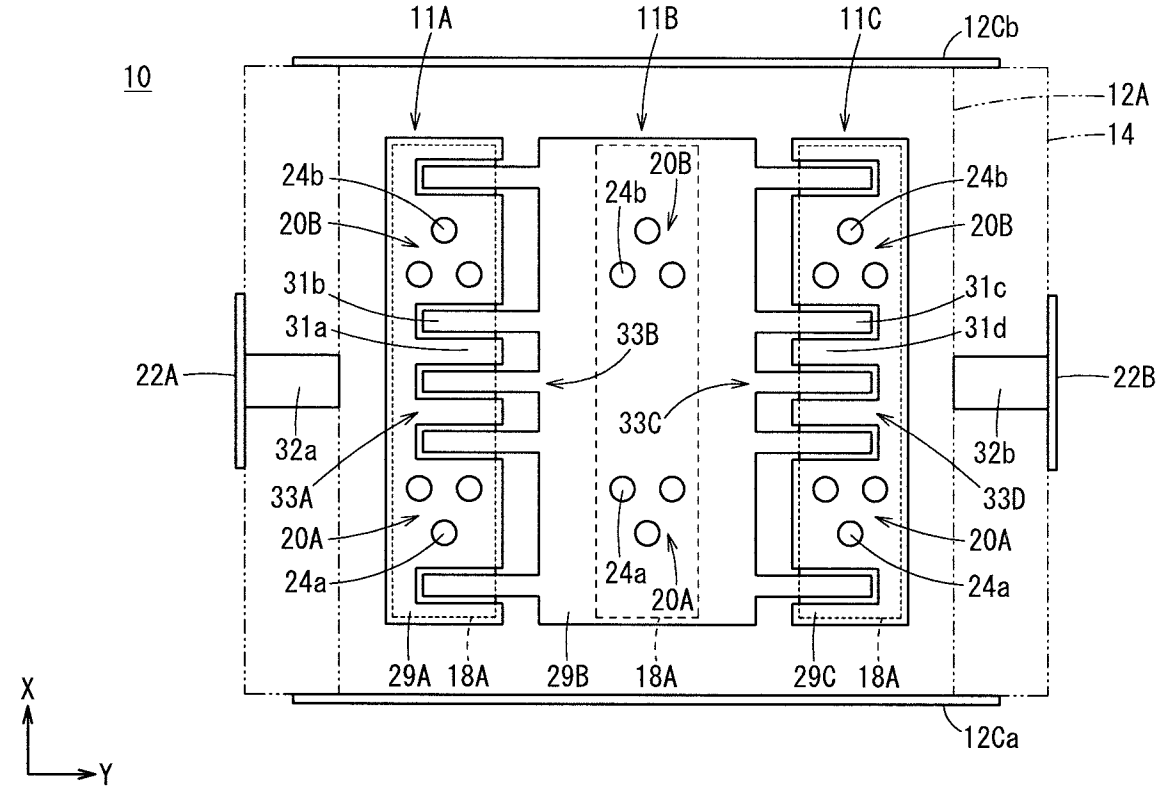
FIG. 3 is a plan view showing the filter according to the first embodiment.

A filter according to a first embodiment will be described using the drawings. FIG. 1 is a perspective view showing the filter according to the present embodiment. FIGS. 2A and 2B are cross-sectional views showing the filter according to the present embodiment. FIG. 2A corresponds to the line IIA-IIA of FIG. 1. FIG. 2B corresponds to the line IIB-IIB of FIG. 1. FIG. 3 is a plan view showing the filter according to the present embodiment.

As shown in FIG. 1, a filter 10 according to the present embodiment includes a dielectric substrate 14. The dielectric substrate 14 is formed in a parallelepiped shape, for example. The dielectric substrate 14 is configured by laminating a plurality of ceramics sheets (dielectric ceramics sheets).

On one principal surface side of the dielectric substrate 14, that is, on an upper side of the dielectric substrate 14 in FIG. 1, there is formed an upper shielding conductor (a shielding conductor, a second shielding conductor) 12A. On the other principal surface side of the dielectric substrate 14, that is, on a lower side of the dielectric substrate 14 in FIG. 1, there is formed a lower shielding conductor (a shielding conductor, a first shielding conductor) 12B.

A first side surface 14*a* among the four side surfaces of the dielectric substrate 14 has formed thereon a first input/output terminal (an input/output terminal) 22A. A second side surface 14*b* facing the first side surface 14*a* has formed thereon a second input/output terminal (an input/output terminal) 22B. The first input/output terminal 22A is coupled to the upper shielding conductor 12A via a first connection line 32*a*. Moreover, the second input/output terminal 22B is coupled to the upper shielding conductor 12A via a second connection line 32*b*.

A third side surface 14*c* among the four side surfaces of the dielectric substrate 14 has formed thereon a first side surface shielding conductor (a shielding conductor) 12Ca. A fourth side surface 14*d* facing the third side surface 14*c* has formed thereon a second side surface shielding conductor (a shielding conductor) 12Cb.

A direction normal to the third side surface 14*c* and the fourth side surface 14*d* is assumed to be an X direction (a first direction). A direction normal to the first side surface 14*a* and the second side surface 14*b* is assumed to be a Y direction (a second direction). A direction normal to the one principal surface and the other principal surface of the dielectric substrate 14 is assumed to be a Z direction.

The dielectric substrate 14 has formed therein a strip line (a first strip line) 18A that faces the lower shielding conductor 12B. A longitudinal direction of the strip line 18A is the X direction.

The dielectric substrate 14 has further formed therein a via electrode portion 20. The via electrode portion 20 includes a first via electrode portion (a via electrode portion) 20A and a second via electrode portion (a via electrode portion) 20B. One end of the via electrode portion 20 is connected to the strip line 18A. The other end of the via electrode portion 20 is connected to the upper shielding conductor 12A. Thus, the via electrode portion 20 is formed from the strip line 18A to the upper shielding conductor 12A. A longitudinal direction of the via electrode portion 20 is the Z direction. The strip line 18A and the via electrode portion 20 configure a structure 16. The filter 10 is provided with a plurality of resonators 11A to 11C that each include the structure 16. The resonators 11A to 11C are arranged in the Y direction.

The first via electrode portion 20A is configured from a plurality of first via electrodes (via electrodes) 24*a*. The second via electrode portion 20B is configured from a plurality of second via electrodes (via electrodes) 24*b*. In the dielectric substrate 14, the first via electrode portion 20A is positioned on a first side surface shielding conductor 12Ca side, and the second via electrode portion 20B is positioned on a second side surface shielding conductor 12Cb side. The first via electrodes 24*a* and the second via electrodes 24*b* are respectively embedded in via holes formed in the dielectric substrate 14. No other via electrode portion exists between the first via electrode portion 20A and the second via electrode portion 20B.

The dielectric substrate 14 has further formed therein a first coupling capacitance electrode 29A, a second coupling capacitance electrode 29B, and a third coupling capacitance electrode 29C. The first coupling capacitance electrode (a coupling capacitance electrode) 29A is provided to the resonator (a first resonator) 11A. The second coupling capacitance electrode (a coupling capacitance electrode) 29B is provided to the resonator (a second resonator) 11B. The third coupling capacitance electrode (a coupling capacitance electrode) 29C is provided to the resonator (a third resonator) 11C. The first coupling capacitance electrode 29A, the second coupling capacitance electrode 29B, and the third coupling capacitance electrode 29C are formed in the same layer. In other words, the first coupling capacitance electrode 29A, the second coupling capacitance electrode 29B, and the third coupling capacitance electrode 29C are formed on the same ceramics sheet (not illustrated). A longitudinal direction of the coupling capacitance electrodes 29A to 29C is the X direction.

The first coupling capacitance electrode 29A is connected to the via electrode portion 20 of the first resonator 11A. An upper surface of the first coupling capacitance electrode 29A is connected to the upper shielding conductor 12A by an upper portion of the via electrode portion 20 of the first resonator 11A. A lower surface of the first coupling capacitance electrode 29A is connected to the strip line 18A of the first resonator 11A by a lower portion of the via electrode portion 20 of the first resonator 11A.

The second coupling capacitance electrode 29B is connected to the via electrode portion 20 of the second resonator 11B. An upper surface of the second coupling capacitance electrode 29B is connected to the upper shielding conductor 12A by an upper portion of the via electrode portion 20 of the second resonator 11B. A lower surface of the second coupling capacitance electrode 29B is connected to the strip line 18A of the second resonator 11B by a lower portion of the via electrode portion 20 of the second resonator 11B.

The third coupling capacitance electrode 29C is connected to the via electrode portion 20 of the third resonator 11C. An upper surface of the third coupling capacitance electrode 29C is connected to the upper shielding conductor 12A by an upper portion of the via electrode portion 20 of the third resonator 11C. A lower surface of the third coupling capacitance electrode 29C is connected to the strip line 18A of the third resonator 11C by a lower portion of the via electrode portion 20 of the third resonator 11C.

The first coupling capacitance electrode 29A has a first comb-shaped electrode 33A that includes a plurality of first electrodes 31*a*. A longitudinal direction of the first electrodes 31*a* is the Y direction. The first comb-shaped electrode 33A is positioned on a second coupling capacitance electrode 29B side of the first coupling capacitance electrode 29A.

The second coupling capacitance electrode 29B has a second comb-shaped electrode 33B that includes a plurality of second electrodes 31*b*. A longitudinal direction of the second electrodes 31*b* is the Y direction. The second comb-shaped electrode 33B is positioned on a first coupling capacitance electrode 29A side of the second coupling capacitance electrode 29B. The second coupling capacitance electrode 29B further has a third comb-shaped electrode 33C that includes a plurality of third electrodes 31*c*. A longitudinal direction of the third electrodes 31*c* is the Y direction. The third comb-shaped electrode 33C is positioned on a third coupling capacitance electrode 29C side of the second coupling capacitance electrode 29B.

The third coupling capacitance electrode 29C has a fourth comb-shaped electrode 33D that includes a plurality of fourth electrodes 31*d*. A longitudinal direction of the fourth electrodes 31*d* is the Y direction. The fourth comb-shaped electrode 33D is positioned on a second coupling capacitance electrode 29B side of the third coupling capacitance electrode 29C.

The plurality of first electrodes (electrodes) 31*a* configuring the first comb-shaped electrode 33A and the plurality of second electrodes (electrodes) 31*b* configuring the second comb-shaped electrode 33B are disposed so as to be alternately adjacent to each other. Since the first electrodes 31*a* and the second electrodes 31*b* are disposed so as to be alternately adjacent to each other, a facing area that the first comb-shaped electrode 33A and the second comb-shaped electrode 33B face each other is sufficiently largely secured. Therefore, sufficient electrostatic capacitance is secured between the first coupling capacitance electrode 29A and the second coupling capacitance electrode 29B. The plurality of third electrodes (electrodes) 31*c* configuring the third comb-shaped electrode 33C and the plurality of fourth electrodes (electrodes) 31*d* configuring the fourth comb-shaped electrode 33D are disposed so as to be alternately adjacent to each other. Since the third electrodes 31*c* and the fourth electrodes 31*d* are disposed so as to be alternately adjacent to each other, a facing area that the third comb-shaped electrode 33C and the fourth comb-shaped electrode 33D face each other is sufficiently largely secured. Therefore, sufficient electrostatic capacitance is secured between the second coupling capacitance electrode 29B and the third coupling capacitance electrode 29C.

Figure 4:
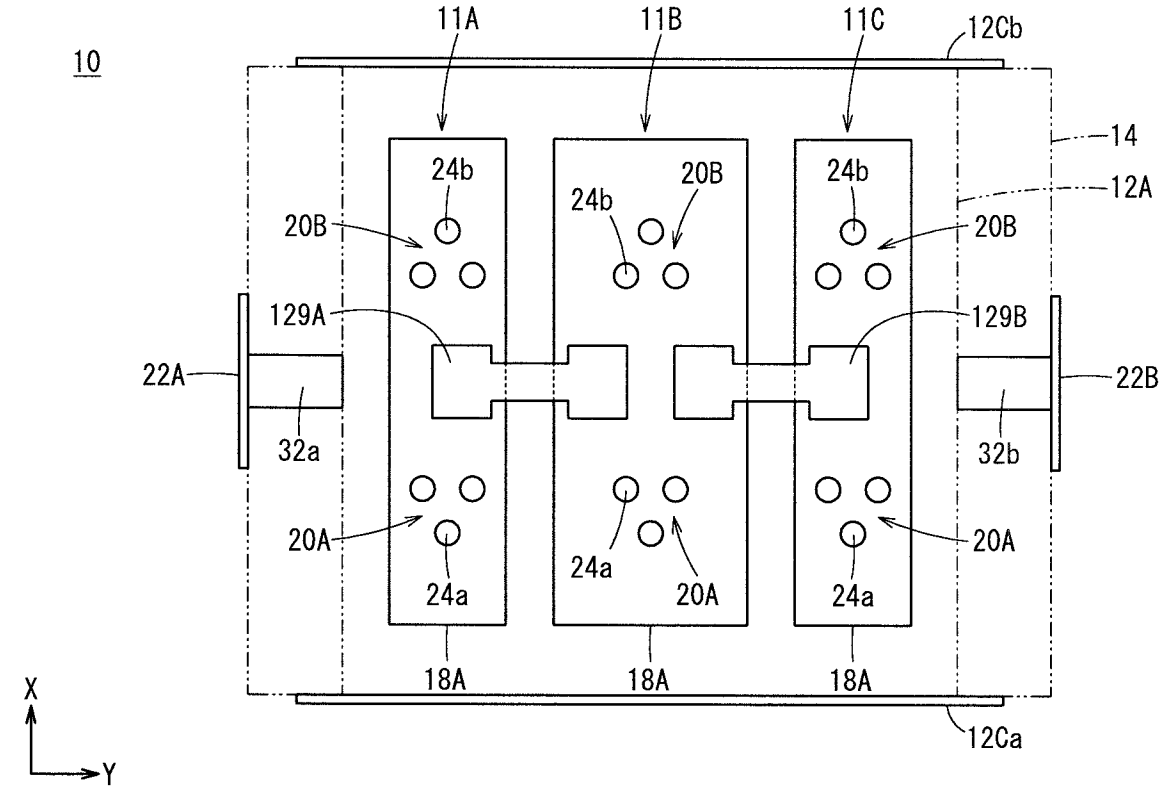
FIG. 4 is a plan view showing a filter according to reference example 1.
Figure 5A:
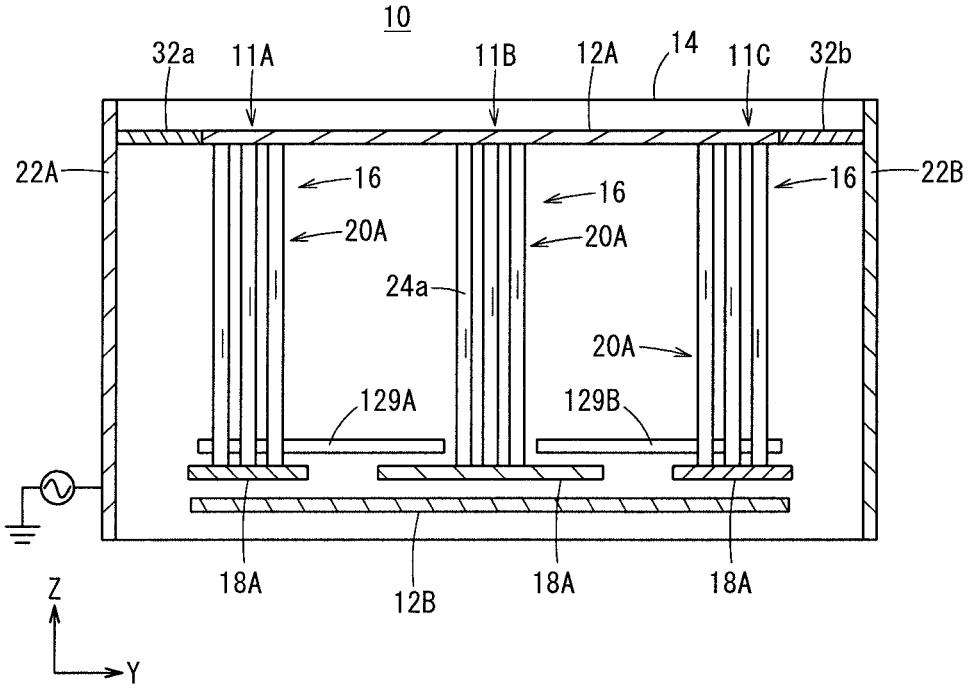
FIGS. 5A and 5B are cross-sectional views showing the filter according to reference example 1.
Figure 5B:
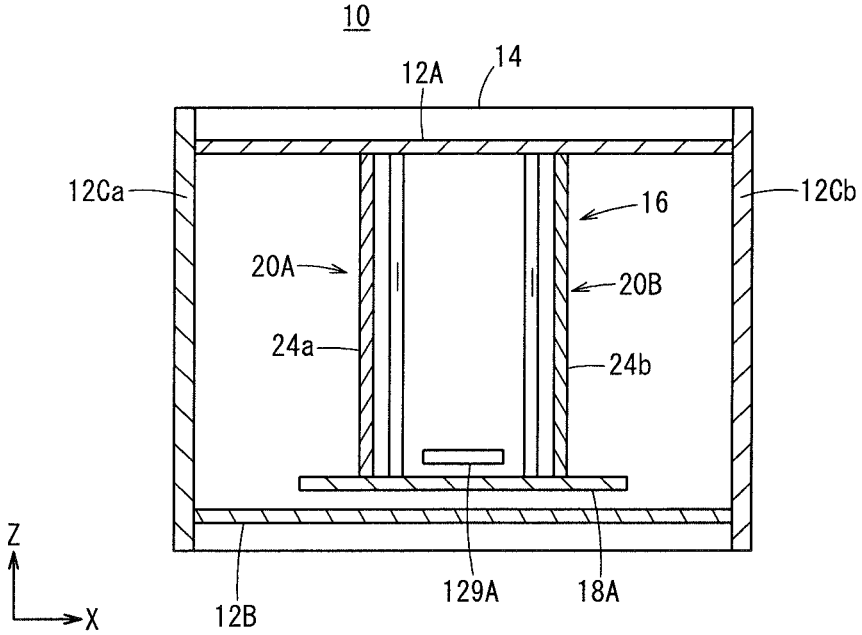

FIG. 4 is a plan view showing a filter according to reference example 1. FIGS. 5A and 5B are cross-sectional views showing the filter according to reference example 1. In the filter according to reference example 1, coupling capacitance electrodes 129A, 129B are formed on a ceramics sheet (not illustrated) covering the strip lines 18A of the resonators 11A to 11C. The coupling capacitance electrode 129A faces the strip line 18A of the first resonator 11A and the strip line 18A of the second resonator 11B. The coupling capacitance electrode 129B faces the strip line 18A of the second resonator 11B and the strip line 18A of the third resonator 11C. Electrostatic capacitance between the strip line 18A of the first resonator 11A and the coupling capacitance electrode 129A varies due to variation in thickness of the ceramics sheet sandwiched between them. Moreover, electrostatic capacitance between the strip line 18A of the second resonator 11B and the coupling capacitance electrode 129A varies due to variation in thickness of the ceramics sheet sandwiched between them. Moreover, electrostatic capacitance between the strip line 18A of the second resonator 11B and the coupling capacitance electrode 129B varies due to variation in thickness of the ceramics sheet sandwiched between them. Moreover, electrostatic capacitance between the strip line 18A of the third resonator 11C and the coupling capacitance electrode 129B varies due to variation in thickness of the ceramics sheet sandwiched between them. Thus, in the filter according to reference example 1, variation occurs in electrostatic capacitance according to variation in thickness of the ceramics sheet. Therefore, in the filter according to reference example 1, a certain amount of variation in characteristics may occur.

Figure 6:
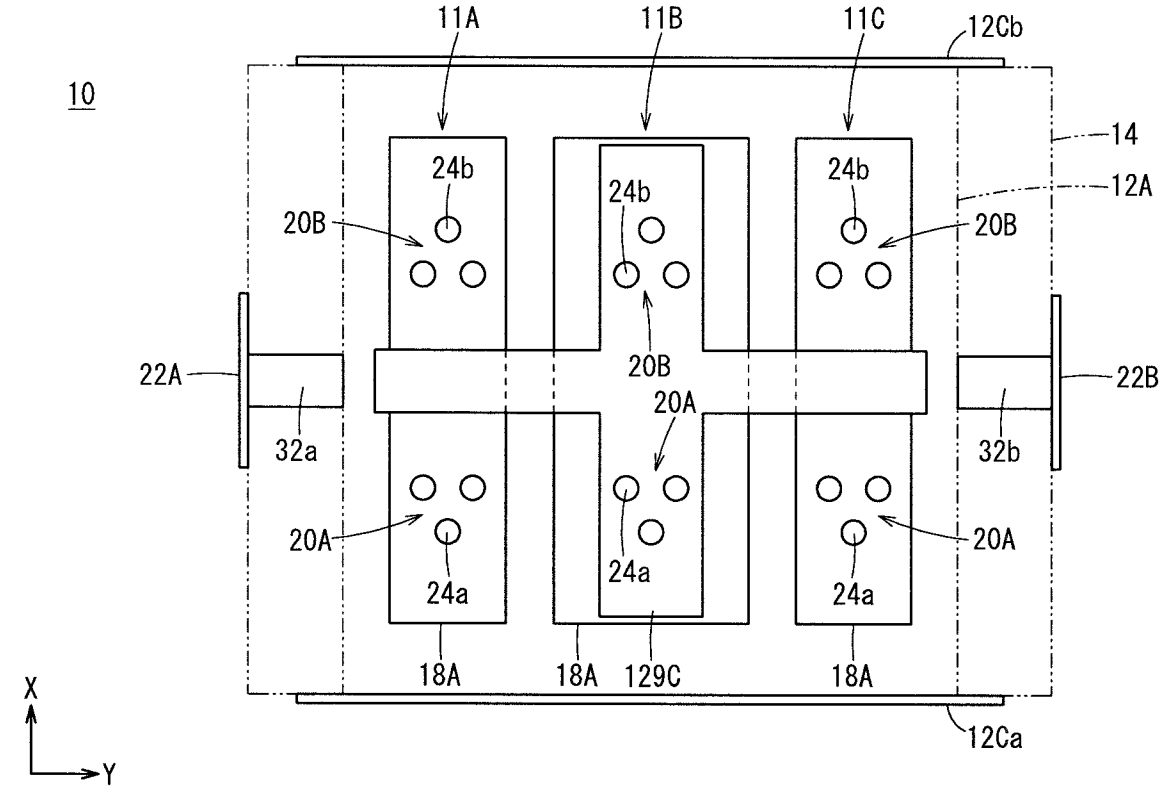
FIG. 6 is a plan view showing a filter according to reference example 2.
Figure 7A:
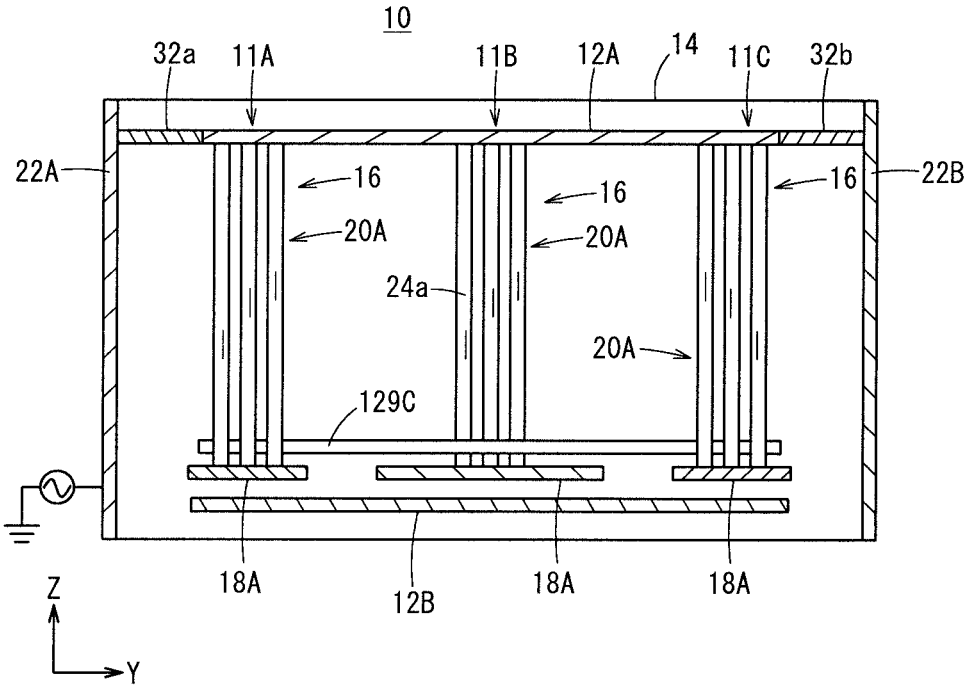
FIGS. 7A and 7B are cross-sectional views showing the filter according to reference example 2.
Figure 7B:
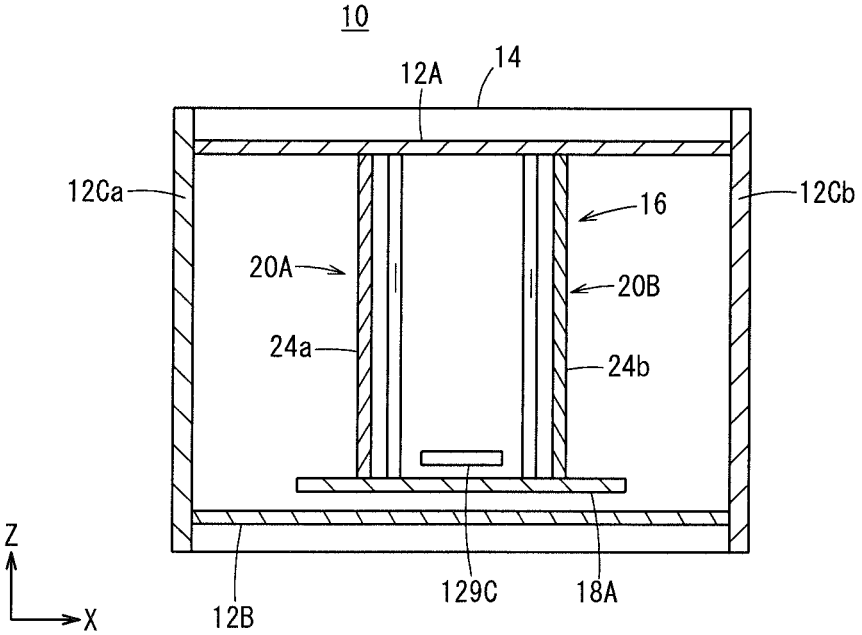

FIG. 6 is a plan view showing a filter according to reference example 2. FIGS. 7A and 7B are cross-sectional views showing the filter according to reference example 2. In the filter according to reference example 2, a coupling capacitance electrode 129C is formed on a ceramics sheet (not illustrated) covering the strip lines 18A of the resonators 11A to 11C. Part of the coupling capacitance electrode 129C faces the strip line 18A of the second resonator 11B. The coupling capacitance electrode 129C is connected to the via electrode portion 20 of the second resonator 11B. The coupling capacitance electrode 129C is connected to the upper shielding conductor 12A by a portion other than a lower portion, of the via electrode portion 20 of the second resonator 11B. The coupling capacitance electrode 129C is connected to the strip line 18A of the second resonator 11B by the lower portion of the via electrode portion 20 of the second resonator 11B. The coupling capacitance electrode 129C extends from above the strip line 18A of the second resonator 11B to above the strip line 18A between the first via electrode portion 20A of the first resonator 11A and the second via electrode portion 20B of the first resonator 11A. The coupling capacitance electrode 129C extends from above the strip line 18A of the second resonator 11B to above the strip line 18A between the first via electrode portion 20A of the third resonator 11C and the second via electrode portion 20B of the third resonator 11C. Electrostatic capacitance between the strip line 18A of the first resonator 11A and the coupling capacitance electrode 129C varies due to variation in thickness of the ceramics sheet sandwiched between them. Moreover, electrostatic capacitance between the strip line 18A of the third resonator 11C and the coupling capacitance electrode 129C varies due to variation in thickness of the ceramics sheet sandwiched between them. Thus, in the filter according to reference example 2 too, variation occurs in electrostatic capacitance according to variation in thickness of the ceramics sheet. Therefore, in the filter according to reference example 2 too, a certain amount of variation in characteristics may occur.

In contrast, in the present embodiment, the first coupling capacitance electrode 29A and the second coupling capacitance electrode 29B are formed in the same layer. Therefore, even if thickness of the ceramics sheets varies, there will never be variation in positional relationship of the first coupling capacitance electrode 29A and the second coupling capacitance electrode 29B. Moreover, in the present embodiment, the second coupling capacitance electrode 29B and the third coupling capacitance electrode 29C are formed in the same layer. Therefore, even if thickness of the ceramics sheets varies, there will never be variation in positional relationship of the second coupling capacitance electrode 29B and the third coupling capacitance electrode 29C. Hence, due to the present embodiment, variation in electrostatic capacitance does not occur, even if thickness of the ceramics sheets varies. Therefore, the present embodiment makes it possible to provide a filter 10 enabling variation in characteristics to be suppressed.

Moreover, in the filter according to reference example 2, the following will happen in the case of the coupling capacitance electrode 129C having been formed misaligned in the Y direction, for example, with respect to the strip line 18A. That is, a difference occurs between electrostatic capacitance between the strip line 18A of the first resonator 11A and the coupling capacitance electrode 129C, and electrostatic capacitance between the strip line 18A of the third resonator 11C and the coupling capacitance electrode 129C. In particular, at high frequency, there is a risk that a difference in electrostatic capacitance caused by positional misalignment will become marked due to an electric field spreading further to outside than an edge of the coupling capacitance electrode 129C and an edge of the strip line 18A. If electrostatic capacitance between the strip line 18A of the first resonator 11A and the coupling capacitance electrode 129C, or electrostatic capacitance between the strip line 18A of the third resonator 11C and the coupling capacitance electrode 129C varies, it leads to variation in filter characteristics. Moreover, the following will happen in the case of there being a large difference between electrostatic capacitance between the strip line 18A of the first resonator 11A and the coupling capacitance electrode 129C, and electrostatic capacitance between the strip line 18A of the third resonator 11C and the coupling capacitance electrode 129C. That is, in such a case, there is a risk that reflection characteristics in a pass band end up deteriorating.

In contrast, in the present embodiment, the first coupling capacitance electrode 29A, the second coupling capacitance electrode 29B, and the third coupling capacitance electrode 29C are formed in the same layer. Therefore, in the present embodiment, there will never occur positional misalignment between the first coupling capacitance electrode 29A, the second coupling capacitance electrode 29B, and the third coupling capacitance electrode 29C. Therefore, in the present embodiment, there will never be a large variation in electrostatic capacitance between the first coupling capacitance electrode 29A and the second coupling capacitance electrode 29B, and electrostatic capacitance between the second coupling capacitance electrode 29B and the third coupling capacitance electrode 29C. Therefore, the present embodiment enables variation in filter characteristics to be suppressed. Moreover, due to the present embodiment, there will never occur a large difference between electrostatic capacitance between the first coupling capacitance electrode 29A and the second coupling capacitance electrode 29B, and electrostatic capacitance between the second coupling capacitance electrode 29B and the third coupling capacitance electrode 29C. Hence, the present embodiment makes it possible to prevent deterioration of reflection characteristics in a pass band, and makes it possible to provide a filter 10 having good characteristics.

Figure 8:
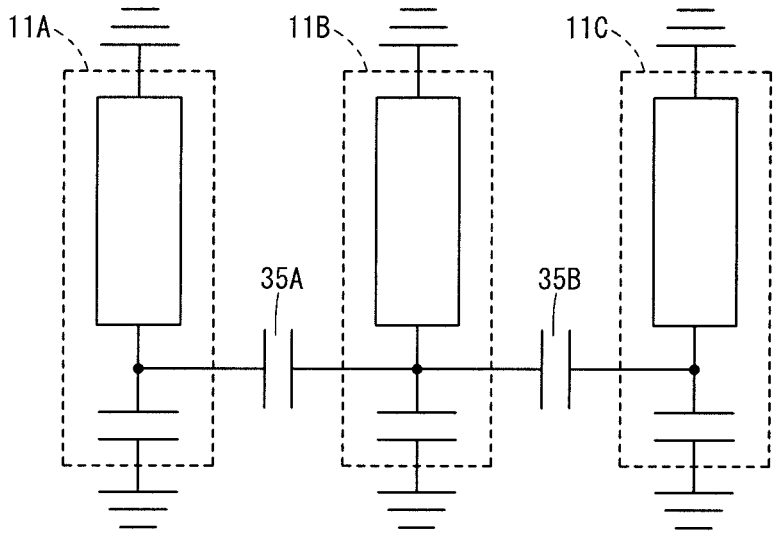
FIG. 8 is a view showing an equivalent circuit of the filter according to the first embodiment.

FIG. 8 is a view showing an equivalent circuit of the filter 10 according to the present embodiment. As shown in FIG. 8, a capacitor 35A exists between the first resonator 11A and the second resonator 11B. Moreover, as shown in FIG. 8, a capacitor 35B exists between the second resonator 11B and the third resonator 11C. As mentioned above, in the present embodiment, the first coupling capacitance electrode 29A and the second coupling capacitance electrode 29B are formed in the same layer. Therefore, even if thickness of the ceramics sheets varies, there will never be variation in the positional relationship of the first coupling capacitance electrode 29A and the second coupling capacitance electrode 29B. Therefore, even if thickness of the ceramics sheets varies, there will never be variation in electrostatic capacitance of the capacitor 35A. Moreover, in the present embodiment, the second coupling capacitance electrode 29B and the third coupling capacitance electrode 29C are formed in the same layer. Therefore, even if thickness of the ceramics sheets varies, there will never be variation in the positional relationship of the second coupling capacitance electrode 29B and the third coupling capacitance electrode 29C. Therefore, even if thickness of the ceramics sheets varies, there will never be variation in electrostatic capacitance of the capacitor 35B. Since variation in electrostatic capacitance will not occur even if thickness of the ceramics sheets varies, the present embodiment makes it possible to provide a filter 10 enabling variation in characteristics to be suppressed.

Figure 9B:
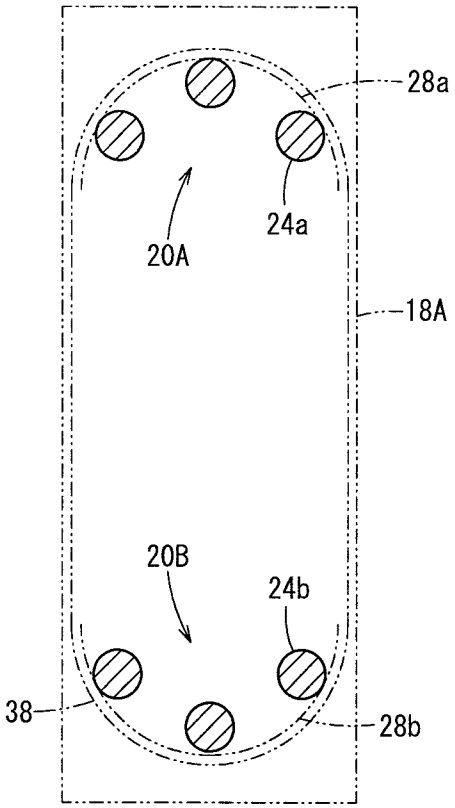
FIGS. 9A and 9B are plan views showing examples of arrangement of first via electrodes and second via electrodes.
Figure 9A:
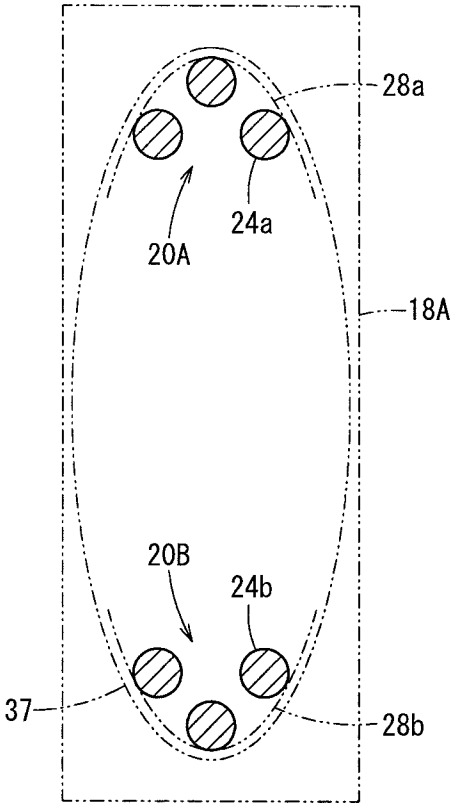

FIGS. 9A and 9B are plan views showing examples of arrangement of the first via electrodes and the second via electrodes. FIG. 9A shows an example where the first via electrodes 24*a* and the second via electrodes 24*b* are disposed so as to lie along parts of an imaginary ellipse 37. FIG. 9B shows an example where the first via electrodes 24*a* and the second via electrodes 24*b* are disposed so as to lie along parts of an imaginary track shape 38. The track shape refers to a shape configured from two facing semicircular portions and two parallel straight-line portions connecting these semicircular portions.

In the example shown in FIG. 9A, the plurality of first via electrodes 24*a* are arranged along an imaginary first curved line 28*a* configuring part of the imaginary ellipse 37, when viewed from an upper surface. Moreover, in the example shown in FIG. 9A, the plurality of second via electrodes 24*b* are arranged along an imaginary second curved line 28*b* configuring part of the imaginary ellipse 37, when viewed from the upper surface. In the example shown in FIG. 9B, the plurality of first via electrodes 24*a* are arranged along an imaginary first curved line 28*a* configuring part of the imaginary track shape 38, when viewed from an upper surface. Moreover, in the example shown in FIG. 9B, the plurality of second via electrodes 24*b* are arranged along an imaginary second curved line 28*b* configuring part of the imaginary track shape 38, when viewed from the upper surface.

It is for the following reasons that the first via electrodes 24*a* and the second via electrodes 24*b* are arranged so as to lie along the imaginary ellipse 37 or the imaginary track shape 38. That is, in the case of the resonators 11A to 11C being multi-staged to configure the filter 10, if a diameter of the via electrode portion 20 is simply made larger, then an electric wall occurs between the resonators 11A to 11C, leading to a deterioration in Q-factor. In contrast, if the via electrode portion 20 is configured as the imaginary ellipse 37, and the resonators 11A to 11C are multi-staged in a short axis direction of the imaginary ellipse 37, then a distance between each other of the via electrode portions 20 becomes longer, hence the Q-factor can be improved. Moreover, if the via electrode portion 20 is configured as the imaginary track shape 38, and the resonators 11A to 11C are multi-staged in a direction perpendicular to a longitudinal direction of the straight-line portions of the imaginary track shape 38, then a distance between each other of the via electrode portions 20 becomes longer, hence the Q-factor can be improved. It is for such reasons that, in the present embodiment, the first via electrodes 24*a* and the second via electrodes 24*b* are arranged so as to lie along the imaginary ellipse 37 or the imaginary track shape 38.

Moreover, it is for the following reasons that the first via electrodes 24*a* and the second via electrodes 24*b* are respectively disposed in end portions of the imaginary ellipse 37, that is, in both end portions where curvature is large, of the imaginary ellipse 37. Moreover, it is for the following reasons that the first via electrodes 24*a* and the second via electrodes 24*b* are respectively disposed in the semicircular portions of the imaginary track shape 38. That is, a high frequency current concentrates in the end portions of the imaginary ellipse 37, that is, in both end portions where curvature is large, of the imaginary ellipse 37. Moreover, a high frequency current concentrates in both end portions of the imaginary track shape 38, that is, in the semicircular portions of the imaginary track shape 38. Therefore, even if the via electrodes 24*a*, 24*b* are configured not to be disposed in a portion other than both end portions of the imaginary ellipse 37 or the imaginary track shape 38, it never leads to a significant lowering of the high frequency current. In addition, if the number of via electrodes 24*a*, 24*b* is reduced, a time required for forming the via electrodes 24*a*, 24*b* can be shortened, hence an improvement in throughput can be achieved. Moreover, if the number of via electrodes 24*a*, 24*b* is reduced, a material such as silver embedded in the via electrodes 24*a*, 24*b* may be reduced, hence a reduction in costs can also be achieved. Moreover, since a region where an electromagnetic field is comparatively sparse is formed between the first via electrode portion 20A and the second via electrode portion 20B, it is possible also for a strip line for coupling adjustment, and so on, to be formed in the region. It is from such viewpoints that, in the present embodiment, the first via electrodes 24*a* and the second via electrodes 24*b* are disposed in both end portions of the imaginary ellipse 37 or the imaginary track shape 38.

The via electrode portion 20 and the first side surface shielding conductor 12Ca and second side surface shielding conductor 12Cb behave like a semi-coaxial resonator. Orientation of current flowing in the via electrode portion 20 and orientation of current flowing in the first side surface shielding conductor 12Ca are opposite, and moreover, orientation of current flowing in the via electrode portion 20 and orientation of current flowing in the second side surface shielding conductor 12Cb are opposite. Therefore, an electromagnetic field can be confined in a portion surrounded by the shielding conductors 12A, 12B, 12Ca, 12Cb, and loss due to radiation can be reduced and effects on outside reduced. At a certain timing during resonance, current flows so as to diffuse from a center of the upper shielding conductor 12A to an entire surface of the upper shielding conductor 12A. At this time, current flows in the lower shielding conductor 12B so as to concentrate from an entire surface of the lower shielding conductor 12B toward a center of the lower shielding conductor 12B. Moreover, at another timing during resonance, current flows so as to diffuse from the center of the lower shielding conductor 12B to the entire surface of the lower shielding conductor 12B. At this time, current flows in the upper shielding conductor 12A so as to concentrate from the entire surface of the upper shielding conductor 12A toward the center of the upper shielding conductor 12A. The current flowing so as to diffuse to the entire surface of the upper shielding conductor 12A or lower shielding conductor 12B similarly flows, as is, in the first side surface shielding conductor 12Ca and second side surface shielding conductor 12Cb too. That is, the current flows in a conductor of broad line width. In a conductor of broad line width, a resistance component is small, hence deterioration in Q-factor is small. The first via electrode portion 20A and the second via electrode portion 20B realize a TEM wave resonator in conjunction with the shielding conductors 12A, 12B, 12Ca, 12Cb. That is, the first via electrode portion 20A and the second via electrode portion 20B realize a TEM wave resonator with reference to the shielding conductors 12A, 12B, 12Ca, 12Cb. The strip line 18A plays a role of forming open end capacitance. Each of the resonators 11A to 11C provided in the filter 10 may operate as a λ/4 resonator.

Thus, in the present embodiment, the coupling capacitance electrodes 29A to 29C are formed in the same layer. Therefore, even if thickness of the ceramics sheets varies, there will never be variation in positional relationship between the coupling capacitance electrode 29A and the coupling capacitance electrode 29B, and there will never be variation in positional relationship between the coupling capacitance electrode 29B and the coupling capacitance electrode 29C. Hence, due to the present embodiment, variation in electrostatic capacitance does not occur even if thickness of the ceramics sheets varies. Therefore, the present embodiment makes it possible to provide a filter 10 enabling variation in characteristics to be suppressed.

Second Embodiment

Figure 10:
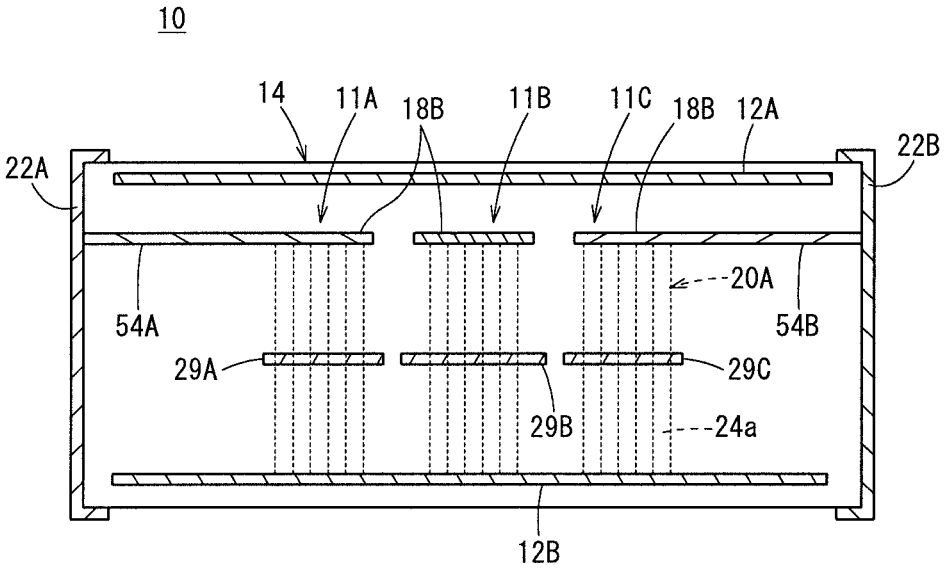
FIG. 10 is a cross-sectional view showing a filter according to a second embodiment.
Figure 11:
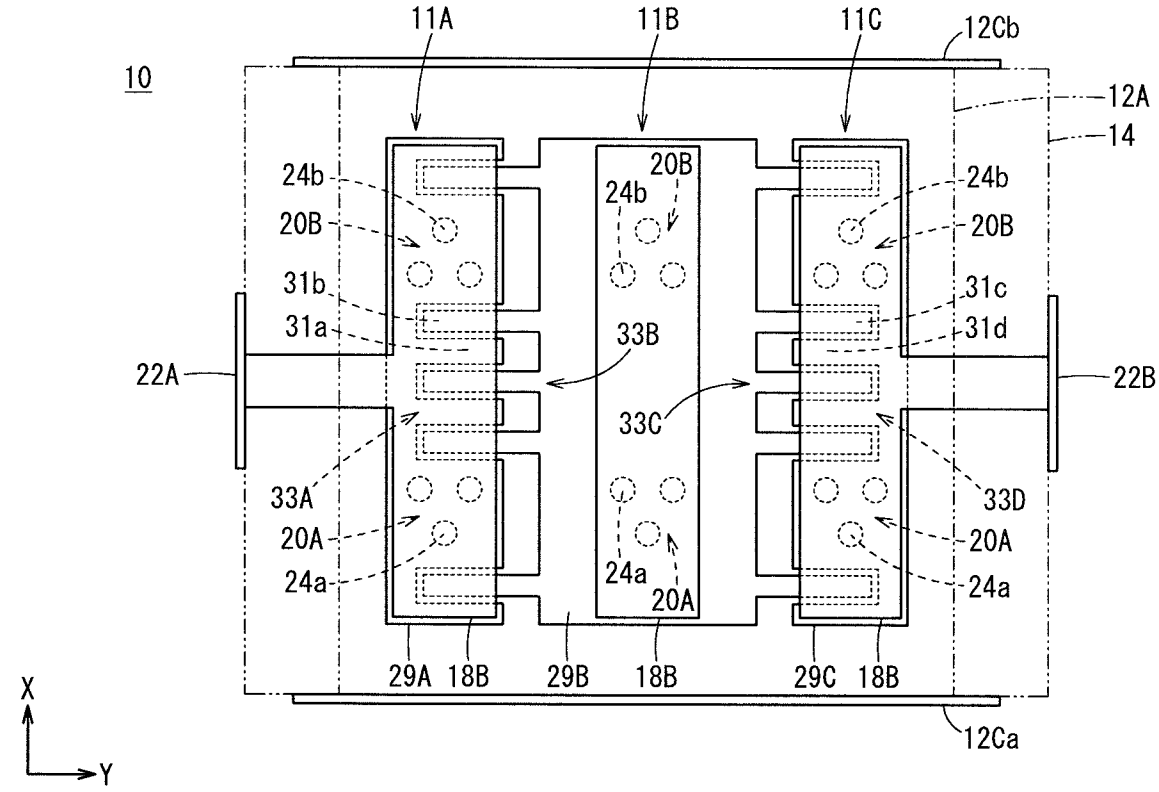
FIG. 11 is a plan view showing the filter according to the second embodiment.

A filter according to a second embodiment will be described using FIGS. 10 and 11. FIG. 10 is a cross-sectional view showing the filter according to the present embodiment. FIG. 11 is a plan view showing the filter according to the present embodiment.

In the present embodiment, a strip line 18B of the first resonator 11A, a strip line 18B of the second resonator 11B, and a strip line 18B of the third resonator 11C face the upper shielding conductor 12A.

The first coupling capacitance electrode 29A, the second coupling capacitance electrode 29B, and the third coupling capacitance electrode 29C are positioned in a layer which is further to a lower side than a layer where the strip lines 18B are formed. The first coupling capacitance electrode 29A, the second coupling capacitance electrode 29B, and the third coupling capacitance electrode 29C are formed in the same layer.

An upper surface of the first coupling capacitance electrode 29A is connected to the strip line 18B of the first resonator 11A by an upper portion of the via electrode portion 20 of the first resonator 11A. A lower surface of the first coupling capacitance electrode 29A is connected to the lower shielding conductor 12B by a lower portion of the via electrode portion 20 of the first resonator 11A.

An upper surface of the second coupling capacitance electrode 29B is connected to the strip line 18B of the second resonator 11B by an upper portion of the via electrode portion 20 of the second resonator 11B. A lower surface of the second coupling capacitance electrode 29B is connected to the lower shielding conductor 12B by a lower portion of the via electrode portion 20 of the second resonator 11B.

An upper surface of the third coupling capacitance electrode 29C is connected to the strip line 18B of the third resonator 11C by an upper portion of the via electrode portion 20 of the third resonator 11C. A lower surface of the third coupling capacitance electrode 29C is connected to the lower shielding conductor 12B by a lower portion of the via electrode portion 20 of the third resonator 11C.

The strip line 18B of the first resonator 11A is connected to the first input/output terminal 22A via a first connection line 54A. The strip line 18B of the third resonator 11C is connected to the second input/output terminal 22B via a second connection line 54B.

In the present embodiment too, the coupling capacitance electrodes 29A to 29C are formed in the same layer. Therefore, even if thickness of the ceramics sheets varies, there will never be variation in positional relationship between the coupling capacitance electrode 29A and the coupling capacitance electrode 29B, and there will never be variation in positional relationship between the coupling capacitance electrode 29B and the coupling capacitance electrode 29C. Hence, variation in electrostatic capacitance does not occur even if thickness of the ceramics sheets varies. Therefore, the present embodiment also makes it possible to provide a filter 10 enabling variation in characteristics to be suppressed.

Third Embodiment

Figure 12A:
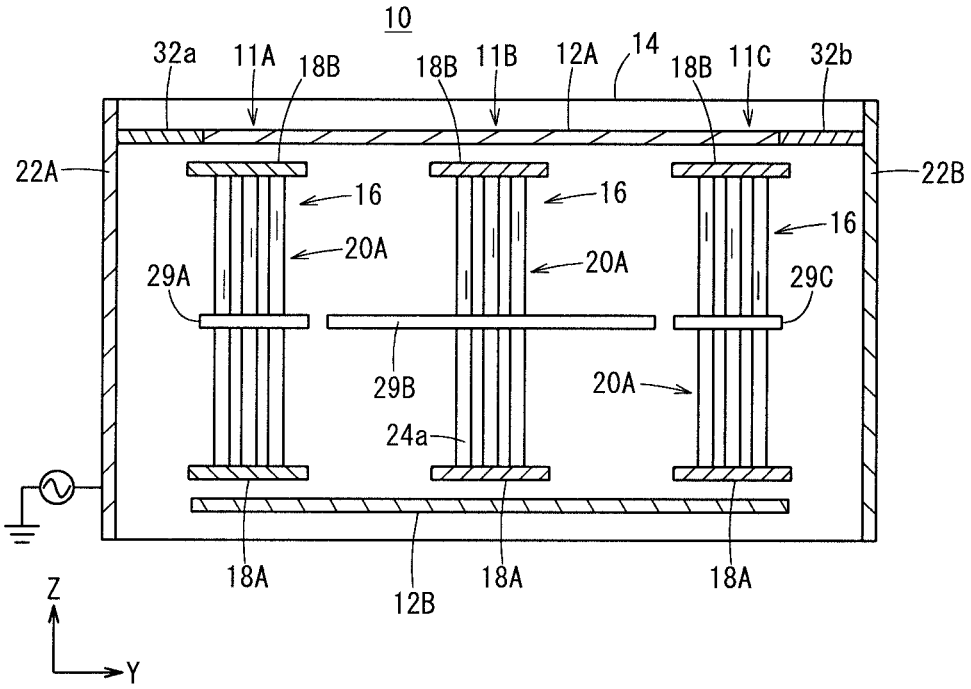
FIGS. 12A and 12B are cross-sectional views showing a filter according to a third embodiment.
Figure 12B:
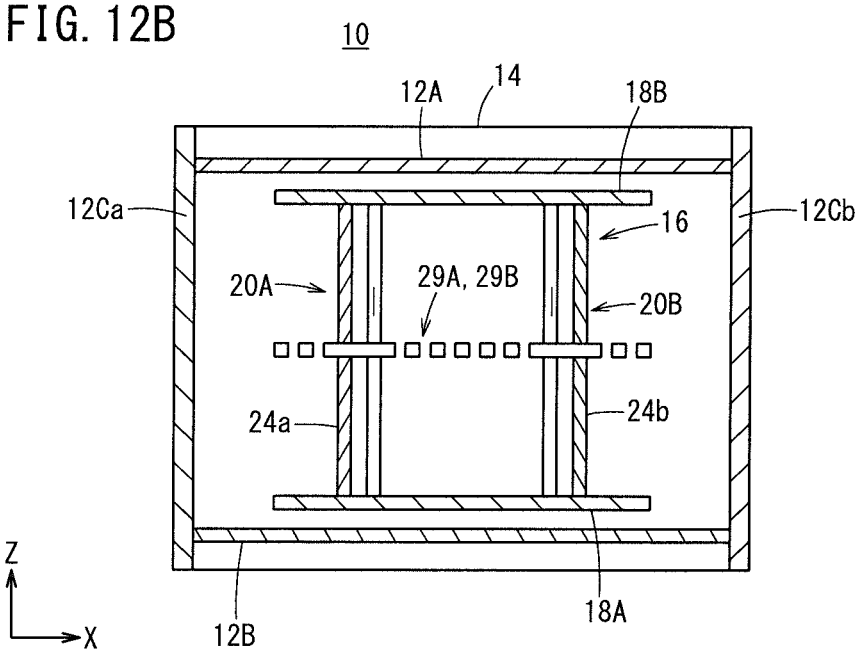
Figure 13:
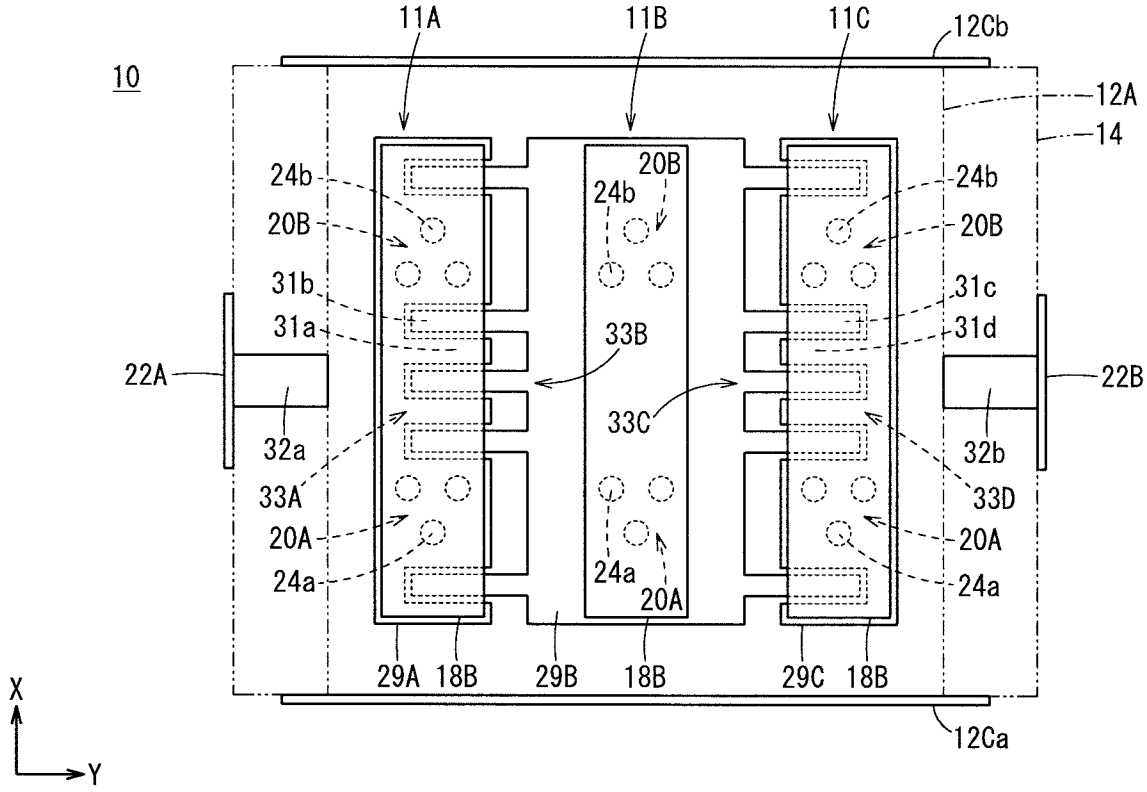
FIG. 13 is a plan view showing the filter according to the third embodiment.

A filter according to a third embodiment will be described using FIGS. 12A to 13. FIGS. 12A and 12B are cross-sectional views showing the filter according to the present embodiment. FIG. 13 is a plan view showing the filter according to the present embodiment.

In the present embodiment, the dielectric substrate 14 has formed therein: an upper strip line (a strip line) 18B that faces the upper shielding conductor 12A; and a lower strip line (a strip line) 18A that faces the lower shielding conductor 12B.

In the present embodiment, one end of the via electrode portion 20 is connected to the upper strip line 18B, and the other end of the via electrode portion 20 is connected to the lower strip line 18A. Thus, the via electrode portion 20 is formed so as to extend from the upper strip line 18B to the lower strip line 18A. The via electrode portion 20 and the strip lines 18A, 18B configure the structure 16.

In the present embodiment too, similarly to in the filters 10 according to the first and second embodiments, the coupling capacitance electrodes 29A to 29C are formed within the dielectric substrate 14.

The via electrode portion 20 and the first side surface shielding conductor 12Ca and second side surface shielding conductor 12Cb behave like a semi-coaxial resonator, similarly to the cases of the filters 10 according to the first and second embodiments.

In the present embodiment, the via electrode portion 20 is not electrically continuous with either the upper shielding conductor 12A or the lower shielding conductor 12B. Electrostatic capacitance (open end capacitance) exists between the upper strip line 18B connected to the via electrode portion 20, and the upper shielding conductor 12A. Moreover, electrostatic capacitance exists also between the lower strip line 18A connected to the via electrode portion 20, and the lower shielding conductor 12B. The via electrode portion 20 configures a λ/2 resonator in conjunction with the upper strip line 18B and the lower strip line 18A.

In a λ/4 resonator like those in the filters 10 according to the first and second embodiments, current concentrates in a portion where a via electrode portion and a shielding conductor are in contact with each other, that is, in a short-circuit portion, during resonance. A portion where a via electrode portion and a shielding conductor are in contact with each other is a portion where a path of the current bends perpendicularly. Concentration of current in a place where the path of the current bends greatly may cause a lowering of the Q-factor. In order to eliminate concentration of current in a short-circuit portion and thereby improve the Q-factor, it is conceivable too for cross-sectional area of the current path to be made larger. For example, it is conceivable for a via diameter to be made larger or for the number of vias to be increased. However, in the case of doing so, size of the resonator ends up increasing, and a requirement of downsizing of the resonator cannot be fulfilled. In contrast, in the present embodiment, the via electrode portion 20 does not contact either the upper shielding conductor 12A or the lower shielding conductor 12B. That is, in the present embodiment, a both end-opened type λ/2 resonator is configured. Therefore, in the present embodiment, a local concentration of current is prevented from occurring in the upper shielding conductor 12A and the lower shielding conductor 12B, and meanwhile, current can be concentrated in a vicinity of a center of the via electrode portion 20. Since it is the via electrode portion 20 alone where current concentrates, that is, since current concentrates where there is continuity (linearity), the present embodiment enables the Q-factor to be improved.

In the present embodiment too, the coupling capacitance electrodes 29A to 29C are formed in the same layer. Therefore, even if thickness of the ceramics sheets varies, there will never be variation in positional relationship of the coupling capacitance electrode 29A and the coupling capacitance electrode 29B, and there will never be variation in positional relationship of the coupling capacitance electrode 29B and the coupling capacitance electrode 29C. Hence, variation in electrostatic capacitance does not occur even if thickness of the ceramics sheets varies. Therefore, the present embodiment too makes it possible to provide a filter 10 enabling variation in characteristics to be suppressed.

Preferred embodiments of the present invention have been presented and described above. However, the present invention is not limited to the above-described embodiments, and a variety of modifications are possible within a range not departing from the gist of the present invention.

For example, in the above-described embodiments, a configuration may be adopted whereby the coupling capacitance electrode 129C of the kind shown in FIGS. 6, 7A, and 7B is further formed on the ceramics sheet (not illustrated) covering the strip lines 18A of the resonators 11A to 11C.

The above-described embodiments may be summarized as follows.

A filter (10) includes: a plurality of resonators (11A to 11C), the plurality of resonators each having a via electrode portion (20) which is formed within a dielectric substrate (14), and the plurality of resonators each having a first strip line (18A) which is connected to one end of the via electrode portion and which faces a first shielding conductor (12B) among a plurality of shielding conductors (12A, 12B, 12Ca, 12Cb) that are formed so as to surround the via electrode portion; a first coupling capacitance electrode (29A) which is provided to a first resonator (11A) among the plurality of resonators and has a first comb-shaped electrode (33A) including a plurality of first electrodes (31*a*); and a second coupling capacitance electrode (29B) which is provided to a second resonator (11B) adjacent to the first resonator, has a second comb-shaped electrode (33B) including a plurality of second electrodes (31*b*), and is formed in the same layer as the first coupling capacitance electrode, wherein the first electrodes and the second electrodes are disposed so as to be alternately adjacent to each other. Due to such a configuration, the first coupling capacitance electrode and the second coupling capacitance electrode are formed in the same layer. Therefore, even if thickness of the ceramics sheets configuring the dielectric substrate varies, there will never be variation in positional relationship of the first coupling capacitance electrode and the second coupling capacitance electrode. Hence, due to such a configuration, variation in electrostatic capacitance does not occur even if thickness of the ceramics sheets varies. Therefore, such a configuration makes it possible to provide a filter enabling variation in characteristics to be suppressed.

A configuration may be adopted whereby the other end of the via electrode portion is connected to a second shielding conductor (12A) that faces the first shielding conductor.

A configuration may be adopted whereby the filter further includes a second strip line (18B) which is connected to the other end of the via electrode portion and which faces a second shielding conductor that faces the first shielding conductor, within the dielectric substrate. Due to such a configuration, a local concentration of current is prevented from occurring in the first shielding conductor and the second shielding conductor, and, at the same time, sufficient current can be concentrated in a vicinity of a center of the via electrode portion. Hence, due to such a configuration, a filter with a good Q-factor can be obtained.

A configuration may be adopted whereby the filter further includes an input/output terminal (22A) which is connected to the second shielding conductor.

A configuration may be adopted whereby the via electrode portion is configured from a plurality of via electrodes (24*a*, 24*b*).

A configuration may be adopted whereby the via electrode portion includes a first via electrode portion (20A) and a second via electrode portion (20B) that are formed adjacently.

A configuration may be adopted whereby the first via electrode portion is configured from a plurality of first via electrodes (24*a*), the second via electrode portion is configured from a plurality of second via electrodes (24*b*), and no other via electrode portion exists between the first via electrode portion and the second via electrode portion. Due to such a configuration, since no other via electrode portion exists between the first via electrode portion and the second via electrode portion, a time required for forming the vias can be shortened, and, consequently, an improvement in throughput can be achieved. Moreover, due to such a configuration, since no other via electrode portion exists between the first via electrode portion and the second via electrode portion, an amount of material such as silver to be embedded in the vias can be small, and, consequently, a reduction in costs can also be achieved. Moreover, since a region where an electromagnetic field is comparatively sparse is formed between the first via electrode portion and the second via electrode portion, it is also possible for a pattern for coupling adjustment, and so on, to be formed in that region.

A configuration may be adopted whereby the plurality of first via electrodes are arranged along an imaginary first curved line (28*a*), when viewed from an upper surface, and the plurality of second via electrodes are arranged along an imaginary second curved line (28*b*), when viewed from an upper surface.

A configuration may be adopted whereby the first curved line and the second curved line configure parts of one imaginary ellipse (37) or parts of one imaginary track shape (38).

REFERENCE SIGNS LIST

10: filter
11A to 11C: resonator
12A: upper shielding conductor
12B: lower shielding conductor
12Ca: first side surface shielding conductor
12Cb: second side surface shielding conductor
14: dielectric substrate
16: structure
18A, 18B: strip line
20: via electrode portion
20A: first via electrode portion
20B: second via electrode portion
22A: first input/output terminal
22B: second input/output terminal
24*a*: first via electrode
24*b*: second via electrode
28*a*: imaginary first curved line
28*b*: imaginary second curved line
29A: first coupling capacitance electrode
29B: second coupling capacitance electrode
29C: third coupling capacitance electrode
31*a*: first electrode
31*b*: second electrode
31*c*: third electrode
31*d*: fourth electrode
33A: first comb-shaped electrode
33B: second comb-shaped electrode
33C: third comb-shaped electrode
33D: fourth comb-shaped electrode
35A, 35B: capacitor
37: imaginary ellipse
38: imaginary track shape
129A to 129C: coupling capacitance electrode

The invention claimed is:

1. A filter comprising:

a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion;

a first coupling capacitance electrode which is provided to a first resonator among the plurality of resonators and includes a first comb-shaped electrode including a plurality of first electrodes; and a second coupling capacitance electrode which is provided to a second resonator adjacent to the first resonator, includes a second comb-shaped electrode including a plurality of second electrodes, and is formed in a same layer as the first coupling capacitance electrode, wherein the first electrodes and the second electrodes are disposed so as to be alternately adjacent to each other.

2. The filter according to claim 1, further including second strip lines which are connected to another end of the via electrode portions and which faces a second shielding conductor that faces the first shielding conductor, within the dielectric substrate.

3. The filter according to claim 1, wherein another end of the via electrode portions is connected to a second shielding conductor that faces the first shielding conductor.

4. The filter according to claim 3, further including an input/output terminal which is connected to the second shielding conductor.

5. The filter according to claim 1, wherein the via electrode portions are configured from a plurality of via electrodes.

6. The filter according to claim 5, wherein the via electrode portions include a first via electrode portion and a second via electrode portion that are formed adjacently.

7. The filter according to claim 6, wherein the first via electrode portion is configured from a plurality of first via electrodes, the second via electrode portion is configured from a plurality of second via electrodes, and no other via electrode portion exists between the first via electrode portion and the second via electrode portion.

8. The filter according to claim 7, wherein the plurality of first via electrodes are arranged along an imaginary first curved line, when viewed from an upper surface, and the plurality of second via electrodes are arranged along an imaginary second curved line, when viewed from an upper surface.

9. The filter according to claim 8, wherein the first curved line and the second curved line configure parts of one imaginary ellipse or parts of one imaginary track shape.

* * * * *